US005348692A

United States Patent [19]

Bickerstaff

[11] Patent Number: 5,348,692

[45] Date of Patent: Sep. 20, 1994

[54] RETRACTABLE COVER UNIT FOR HOT WATER BASIN OF CROSSFLOW COOLING TOWER

[75] Inventor: David M. Bickerstaff, Baytown, Tex.

[73] Assignee: The Marley Cooling Tower Company, Mission Woods, Kans.

[21] Appl. No.: 23,066

[22] Filed: Feb. 24, 1993

[51] Int. Cl.[5] ..... B01F 3/04

[52] U.S. Cl. ..... 261/111; 261/DIG. 11

[58] Field of Search ..... 261/111, DIG. 11

[56] References Cited

U.S. PATENT DOCUMENTS

| | | | |
|---|---|---|---|
| 3,216,708 | 11/1965 | Ferry | 261/111 |
| 3,352,546 | 11/1967 | Greenfield | 261/111 |
| 3,880,964 | 4/1975 | Fordyce et al. | 261/DIG. 11 |
| 4,543,218 | 9/1985 | Bardo et al. | 261/DIG. 11 |
| 4,592,878 | 6/1986 | Scrivnor | 261/111 |

*Primary Examiner*—Tim Miles

*Attorney, Agent, or Firm*—Hovey, Williams, Timmons & Collins

[57] ABSTRACT

A retractable cover unit for a hot water distribution basin of a cooling tower includes a frame secured to the basin and a flaccid cover. The frame includes opposed framing members overlying the opposed side walls of the basin, and a pair of connectors are secured between the framing members and spaced laterally from one another. A plurality of grommets are presented along the lateral sides of the cover through which the connectors are threaded. The end edges of the cover are attached to the framing members for holding the cover over the basin, while structure is provided for detaching at least one of the end edges of the cover to permit the cover to be moved along the connectors allowing access to the basin.

10 Claims, 4 Drawing Sheets

RETRACTABLE COVER UNIT FOR HOT WATER BASIN OF CROSSFLOW COOLING TOWER

BACKGROUND OF THE INVENTION

1. Field of the Invention

The present invention relates generally to covers for protecting basins from overexposure to sunlight and airborne debris and, more particularly, to a retractable cover unit for hot water basins of a crossflow cooling tower.

2. Discussion of the Prior Art

A crossflow cooling tower typically includes a fill structure comprised of a number of vertically stacked and horizontally staggered splash bars which are arranged beneath a hot water distribution basin so that hot water, e.g. having a temperature of about 100° F., falls through the structure over the splash bars while air is directed in a transverse direction through the structure.

During use of these cooling towers, especially in low to middle latitude locations where the towers are exposed to a significant amount of sunlight and warmth, algae growth within the hot water distribution basins is a problem.

Where algae is a problem, frequent cleaning of the distribution basins is required in order to reduce the adverse effect the algae has on efficient operation of the tower. In addition to frequent cleaning of the basins, it is known to provide a cover comprising a frame constructed immediately over the basins and several rigid sheets of plywood or the like. In use, once the frame is constructed, the plywood is laid on top of the frame in order to prevent sunlight from reaching the basin so that algae growth is inhibited.

Numerous problems arise during use of the conventional cover construction. For example, because large sheets of plywood are used, it is difficult for maintenance personnel to remove the cover in order to gain access to the distribution basins. Further, as sometimes occurs, the water level within the basins rises to a point at which the water lifts the plywood sheets from the frame, allowing the sheets to float out of position from over the basin.

An additional problem raised in using the conventional construction occurs in petrochemical applications where gases may be introduced into the basins along with the hot water to be cooled. These gases become trapped beneath the conventional cover unit, and there is a concern that a potentially hazardous condition would exist if the cover was not provided with some means for allowing such gases to escape.

OBJECTS AND SUMMARY OF THE INVENTION

It is an object of the present invention to provide a cover unit that screens the distribution basin of a cooling tower from overexposure to sunlight, while being retractable in order to permit maintenance personnel to easily move the cover to gain access to the basin.

Another object of the present invention is to provide a cover unit in which a cover is constructed of a material which blocks a substantial percentage of the sunlight directed on the basins, while allowing air and gases to flow freely between the covered region of the basin and atmosphere.

It is yet another object of the invention to provide a cover unit having a flaccid cover, and a frame adapted to position the cover over a basin and shape the cover so that snow or heavy airborne debris does not become trapped on the cover forcing the cover down into the basin.

In accordance with these and other objects evident from the following description of a preferred embodiment of the invention, a cover unit is provided for use on a distribution basin of a water cooling tower, wherein the distribution basin includes a floor and opposed side walls.

The cover unit includes a frame secured to the basin and having framing members overlying the side walls of the basin, and a pair of cables secured between the framing members and spaced laterally from one another. A flaccid cover having end edges and laterally spaced side edges is provided which is adapted to be laid across the frame and cables.

A means is provided for presenting a plurality of grommets along the lateral sides of the cover through which the cables are threaded, and a means for attaching the end edges of the cover to the framing members is included for holding the cover over the basin. At least one of the end edges of the cover is detachable to permit the cover to be moved along the cables, this allowing access to the basin.

Preferably, the frame includes a joist mounted to the framing members above and between the cables, the cover being draped up over the joist so that the cover is supported between the cables.

The cover preferably includes a plurality of holes for allowing fluid to pass through the material while a substantial percentage of sunlight striking the cover is prevented from passing into the basin.

By constructing a cover unit in accordance with the present invention, numerous advantageous results are achieved. For example, by providing a flaccid cover having a plurality of grommets through which the cables are threaded, it is possible to reliably retain the cover in place over the basin in order to prevent a substantial amount of sunlight from reaching the basin. In this manner, algae growth, which relies heavily upon sunlight for promotion, is inhibited. At the same time, the inventive unit allows detachment of at least one end of the cover so that the cover may easily be moved by a single person along the cables in order to permit access to the basin.

Further, by providing joists positioned on the frame above and between the cables, the cover is supported in such a way as to prevent snow and other airborne debris from collecting on top of the cover and forcing the cover down into the basin.

Where a cover unit is to be used in an application such as is found in the petrochemical industries, where potentially hazardous gases may be introduced into the hot water basin, it is possible to allow escape of these gases to atmosphere by constructing the unit with a cover provided with holes. By using such a material, gases are allowed to pass through the material in either direction while a substantial percentage of sunlight striking the cover is prevented from passing through the cover into the basin. Further, water is allowed to flow through the cover, either as rain or melted snow into the basin, or as overflow from the basin.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 1:
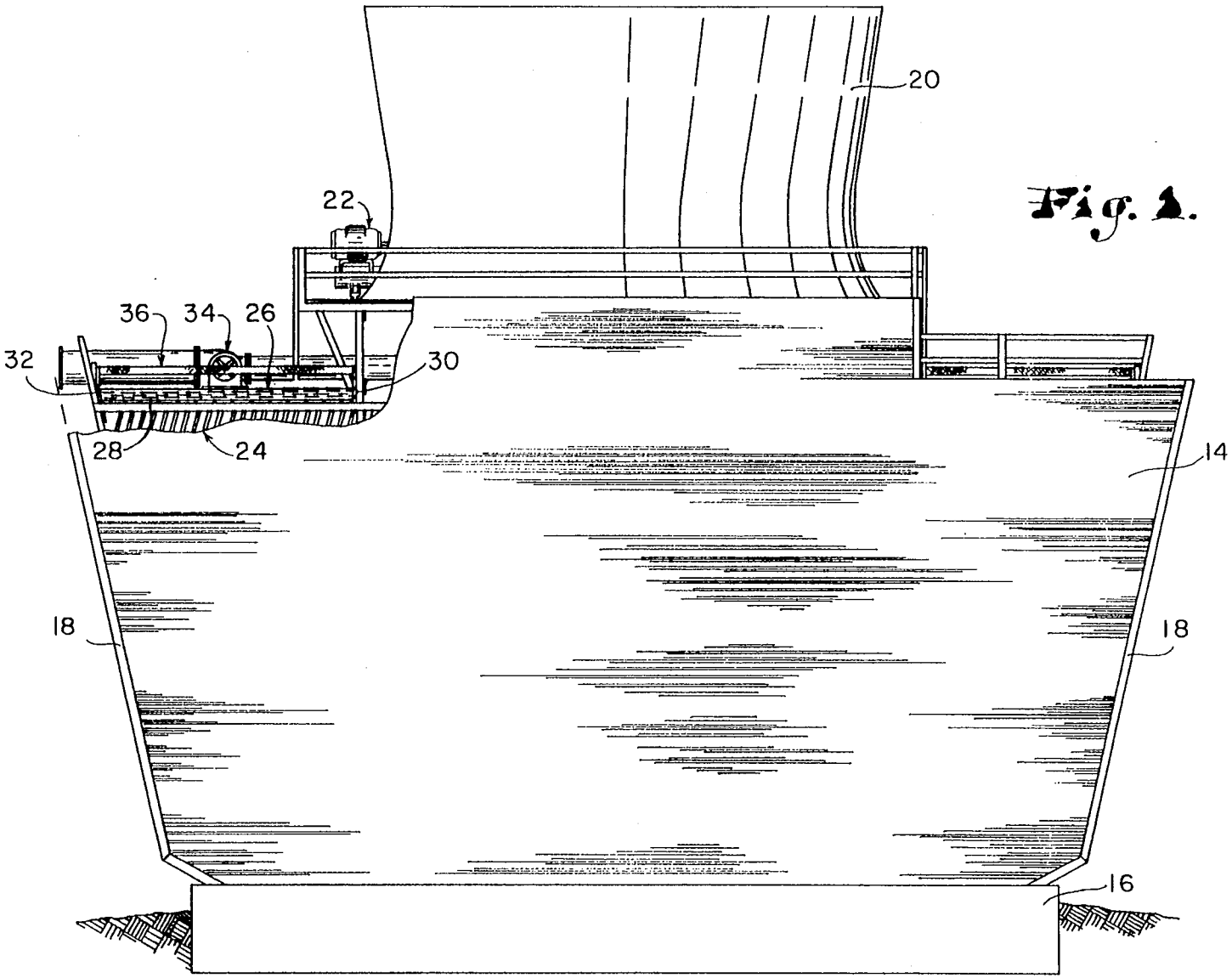
FIG. 1 is a side elevational view, partially cut away, of a crossflow cooling tower and a cover unit constructed in accordance with the preferred embodiment.

A crossflow cooling tower is illustrated in FIG. 1, and includes a superstructure or casing 14 supported on a concrete basin 16. The superstructure is open along the outboard side walls 18 thereof so that air may be drawn into the superstructure through the side walls. A fan stack 20 rests atop the superstructure to define an exhaust for the air flow. Although not shown, a fan may be provided within the tower to provide induced air flow through the tower, and an electric motor 22 is provided for driving the fan.

Within the superstructure, a fill structure 24 is provided adjacent each outboard side wall 18. The fill structure preferably includes a large number of vertically spaced, horizontally staggered splash bars over which water falls. By directing water over these splash bars at the same time air is drawn laterally into the housing through the outboard side walls, the water is cooled by the air.

A hot water distribution basin 26 is constructed above the fill structure, and includes a floor 28, and inboard and outboard side walls 30, 32. At least one flow control unit 34 is associated with the basin for delivering hot water to the basin and controlling the water level. A cover unit 36 prevents a large percentage of the sunlight directed on the basin from reaching the hot water in order to reduce the amount of algae growth within the basin.

Figure 3:
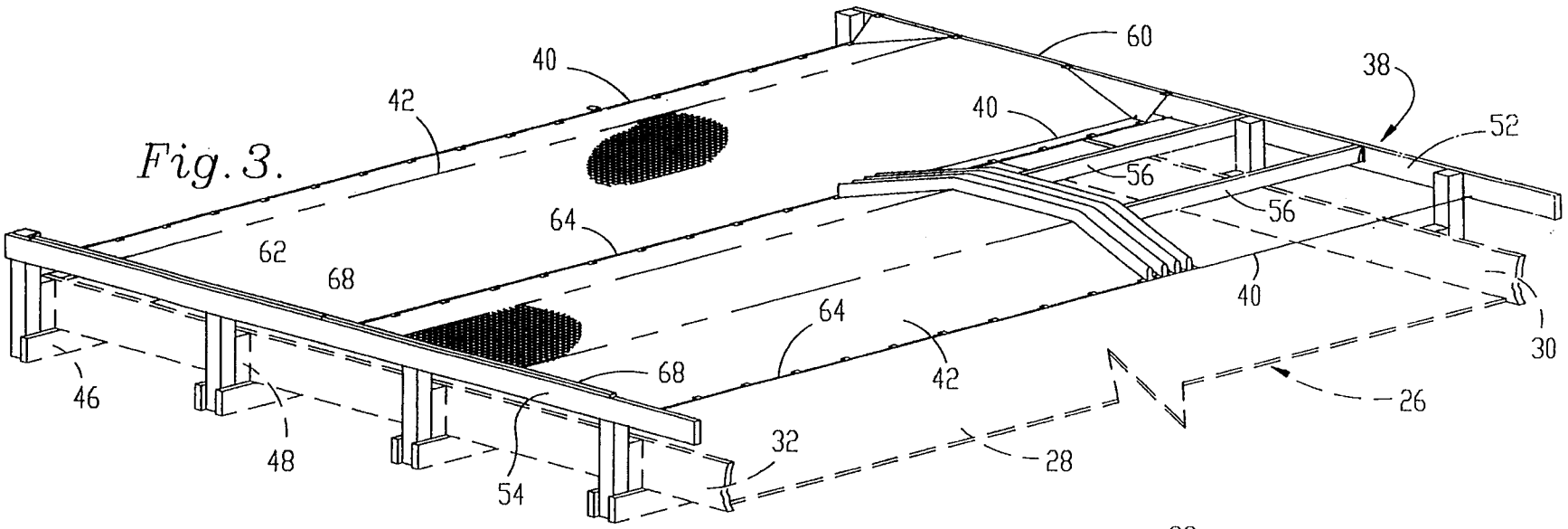
FIG. 3 is a perspective view of the complete cover unit, illustrating one cover in a detached, retracted position and another cover in an attached position.

Turning to FIG. 3, a cover unit is illustrated. The cover unit generally includes a frame 38, a pair of cables 40, and a flaccid cover 42 extending over the frame and connected between the cables. Additional cable pairs and covers are also provided, as required, to cover the entire basin.

Figure 2:
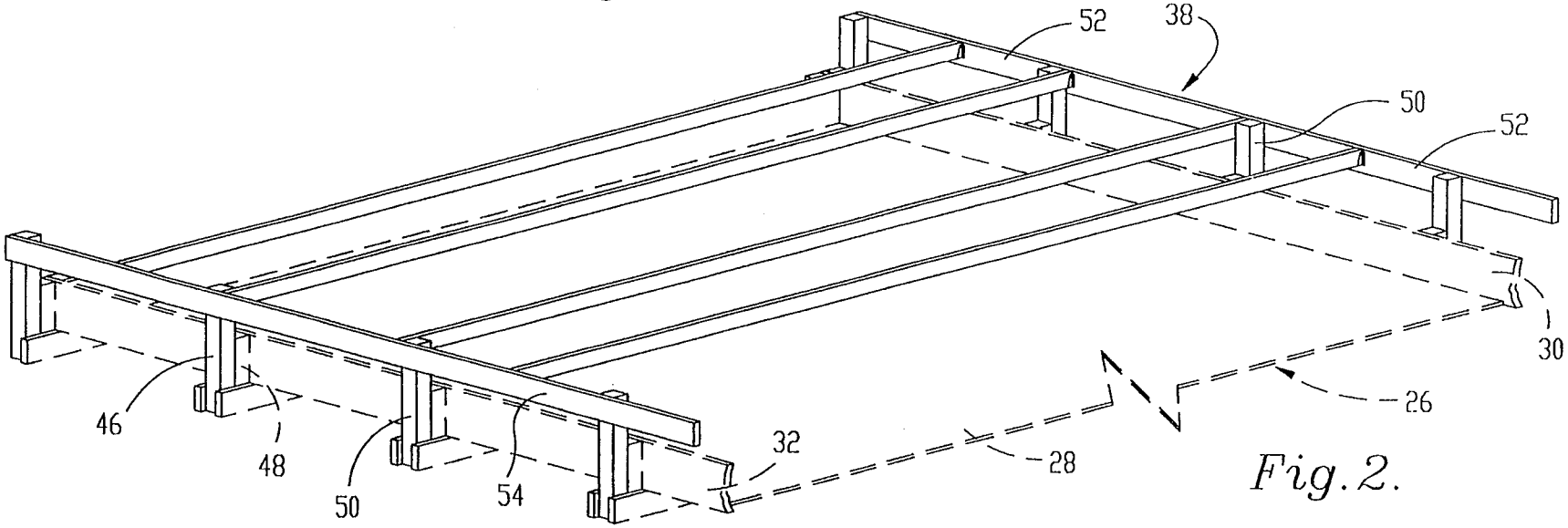
FIG. 2 is a perspective view of a frame of the cover unit as constructed over a basin of the cooling tower.

As illustrated in FIG. 2, the hot water distribution basin of the cooling tower, shown in phantom lines, includes the basin floor 28, end walls 44 and the inboard and outboard side walls 30, 32. Although not shown, the basin floor is provided with a plurality of holes within which nozzles are provided for distributing water from the basin across the splash bars therebeneath. Typically, a pre-existing frame is provided for supporting the basin, and includes a plurality of joists extending between upstanding basin blocks 48.

The frame 38 of the cover unit includes a plurality of stub posts 50, formed of wood or the like, which are secured to the existing basin blocks 48. Inboard and outboard framing members 52, 54 are attached at the upper ends of the stub posts above the existing inboard and outboard side walls 30, 32. Preferably, a plurality of joists 56 are attached between the framing members 52, 54 for supporting each cover above the basin.

The cables 40 of the cover unit are illustrated in FIG. 3, and extend between the framing members. Preferably, each pair of Joists are spaced 3–4 feet from one another, and both joists are disposed above and between the cables 40 associated with the unit. Preferably, each cable is spaced 1–2 feet outside the nearest joist.

Figures 4, 5, 6, 7, 8:
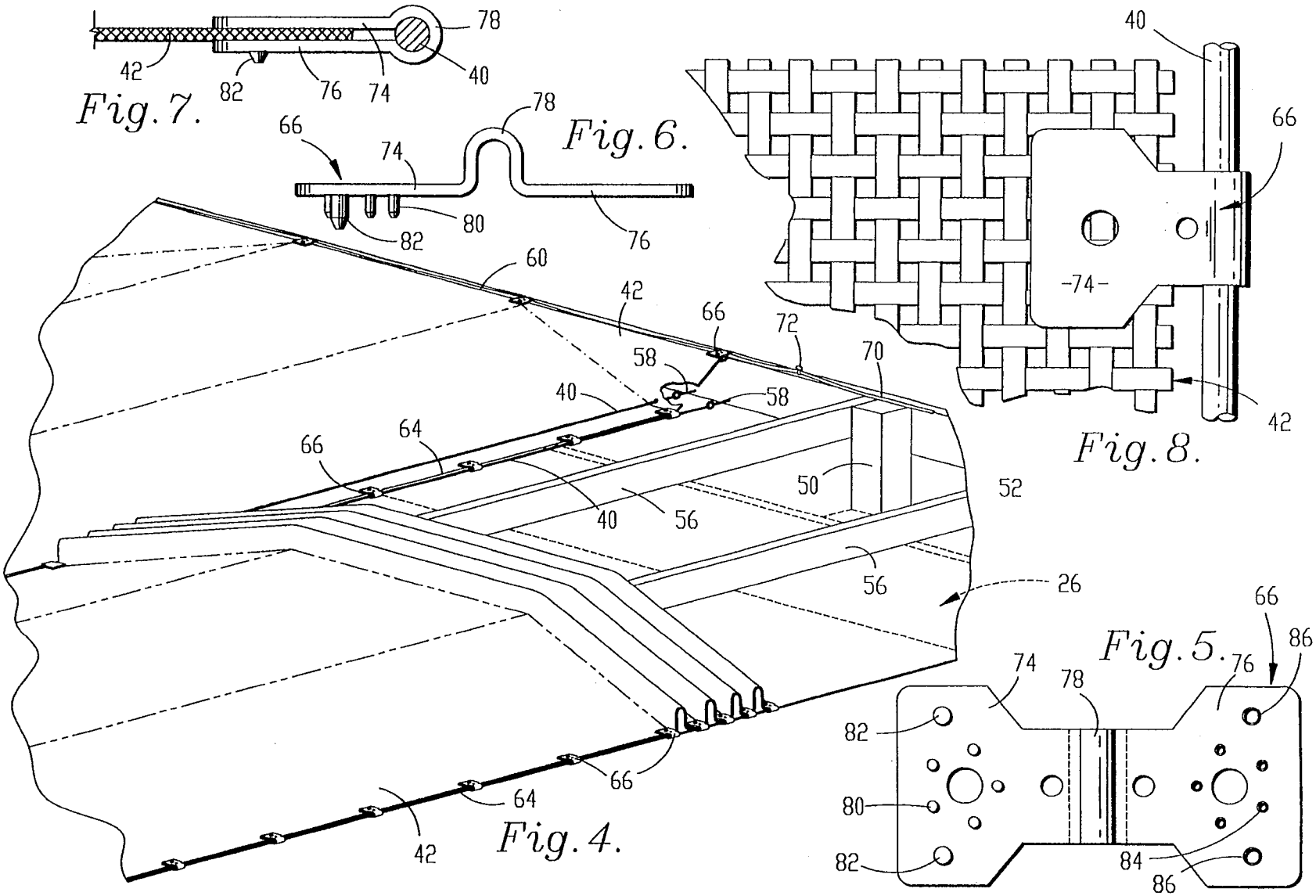
FIG. 4 is a partial perspective view, partially cut away, of the cover unit, illustrating the manner of connection between the cover and the cables and frame.
FIG. 5 is a plan view of an unassembled grommet assembly.
FIG. 6 is a side elevational view of an unassembled grommet assembly.
FIG. 7 is a side elevational view of an assembled grommet assembly.
FIG. 8 is a magnified partial plan view of an assembled grommet assembly, illustrating one of the cables threaded through the grommet.

Turning to FIG. 4, the cables are attached to the framing members by any suitable means, such as eyebolts 58 fastened to the framing members 52, 54 adjacent the lower edges thereof. In this manner, the cables 40 are disposed beneath the upper edge or surface of each joist. The cables 40 are preferably rubber coated steel cables which enable relatively unrestricted sliding movement of the cover along the cables, and which reduce the amount of rust or oxidation of the cables.

Returning to FIG. 3, each cover 42 is shown to be of generally rectangular shape, including inboard and outboard end edges 60, 62 and laterally spaced side edges 64. The side edges of the cover are secured to the cables 40, and the end edges are secured to the inboard and outboard framing members 52, 54, with the cover overlying the joists 56. In this manner, the cover 42 is supported while being shaped to carry snow or airborne debris on top of the cover without drooping into the water below.

A means is provided for presenting a plurality of grommets along the lateral sides of the cover through which the cables are threaded. This means preferably includes a plurality of polypropylene grommet assemblies 66, as shown in FIG. 4, which are secured to the cover 42 to define the grommets.

The means for attaching the end edges 60, 62 of the cover to the framing members includes securing means for securing the outboard edge of the cover to the outboard framing member 62. This attaching means preferably includes a clamp strip 68, as shown in FIG. 3, that may be fastened over the outboard edge 62 of the cover and onto the upper edge or surface of the outboard framing member 54 in order to clamp the cover against the outboard framing member.

The means for attaching the inboard edge 60 of the cover to the inboard framing member 52 includes a plurality of grommet assemblies 66 provided along the inboard edge 60 of the cover, and a twine or cable 70 that may be threaded through the grommets and detachably secured to the inboard framing member 52. By providing this construction, it is possible to retain the cover 42 in position over the basin, while allowing it to be detached and pushed away from the inboard framing member 52 to allow access to the basin.

Preferably, a number of nails 72 or the like may be provided on the inboard framing member to which the twine 70 may be tied to secure the cover 42 over the basin. Removal of the cover then requires simply that the twine 70 be untied from the nails 72 and pulled from the grommets so that the cover may be pushed away from the inboard framing member 52.

Turning to FIG. 8, each cover 42 is shown as being formed of an open weave material having a plurality of holes for allowing fluid to pass through the material while a substantial percentage, e.g. about 80%, of sunlight striking the cover is prevented from reaching the basin. Preferably, the cover material is a woven, vinyl-impregnated polyester yarn and includes a porosity which blocks most of the sunlight striking the cover from reaching the basin. The material is a flaccid, cloth-like material which may be pushed back from the inboard framing member 52 along the cables 40 in a manner similar to that used to push curtains along a curtain rod such that folds or pleats form in the cover as shown in FIG. 4.

An example of the preferred grommet assembly 66 is illustrated in FIG. 5, and is formed of a single piece of semi-flexible polypropylene material. The grommet assembly is divided into two halves 74, 76 by a central, semi-cylindrical ridge 78 protruding from the generally planer surface of the grommet, as shown in FIG. 6. One half 74 of the grommet is provided with a plurality of fabric-engaging pins 80 extending from the grommet in a direction opposite to the direction in which the ridge protrudes, along with a pair of spaced fastening pins 82. A plurality of holes 84, 86 are provided on the other half 76 of the grommet and are positioned and sized to receive the pins 80, 82 respectively. Preferably, each pin 82 is stepped or tapers inward adjacent the surface of the grommet so that when the grommet is folded over onto itself, as illustrated in FIG. 7, the pins 82 extend through and are retained within the holes 86 so as to sandwich the cover material within the grommet assembly 66. At the same time, the smaller pins 80 engage the cover material, preventing it from being easily pulled from the grommet assembly.

The semi-cylindrical ridge 78 of the grommet assembly 66 defines a loop through which one of the cables may be threaded. Each grommet assembly remains fixed to the cover 42 during movement of the cover relative to the cables 40, and each grommet is preferably sized slightly greater than the diameter of the cable in order to permit relative unrestricted movement between the cover and the cables.

Figure 10:
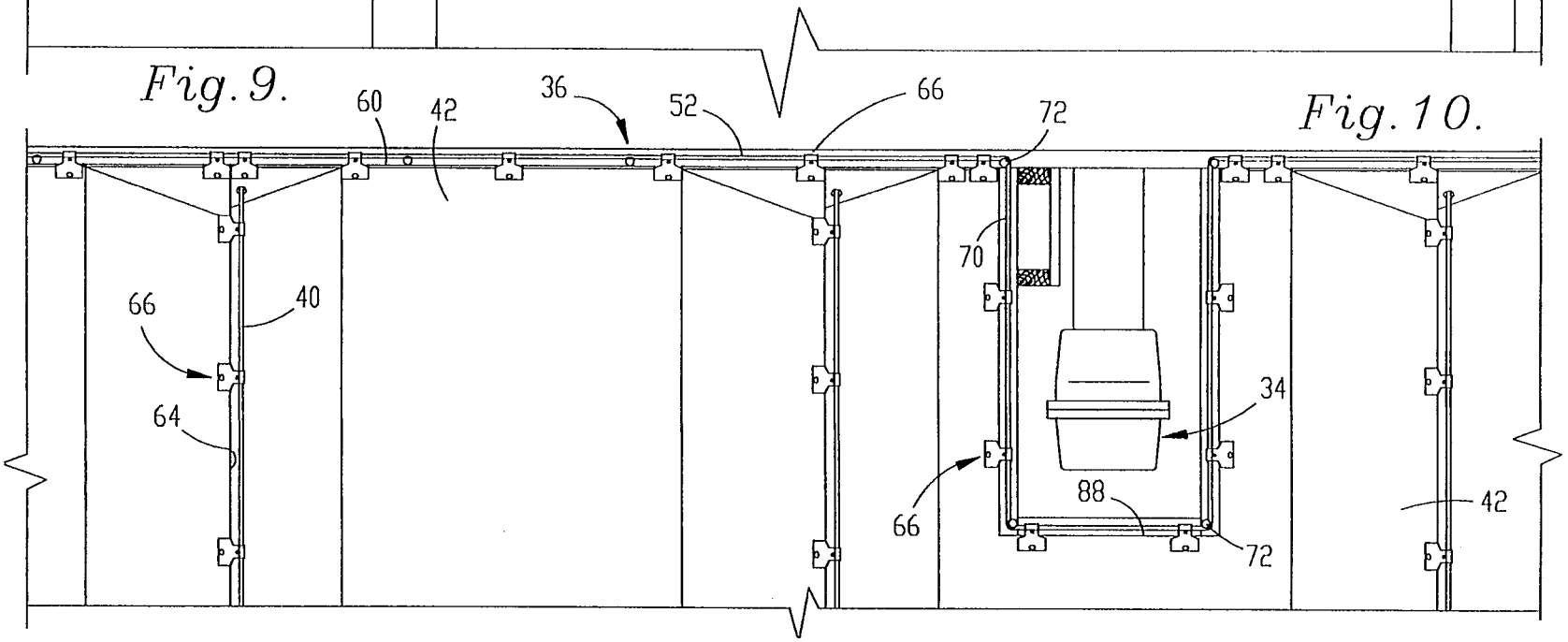
FIG. 10 is a top plan view of the hot water distribution basin of the cooling tower, illustrating a cover unit including a plurality of covers.

For each cover unit used on a distribution basin of a cooling tower, a plurality of covers may be provided, as shown in FIG. 10. Preferably, the frame 38 is constructed over the entire basin, as shown in FIG. 2, and a pair of joists 56 are installed in association with each cover to be utilized. For example, where each cover is formed of a width of about 6 feet, and a plurality of covers are used, two joists would be connected between the inboard and outboard framing members at a 3–4 foot, center-to-center spacing, in association with each cover. The spacing between the outer joist of each pair and the outer joist of an adjacent pair would be approximately 1–3 feet, and preferably just over 2 feet.

Figure 9:
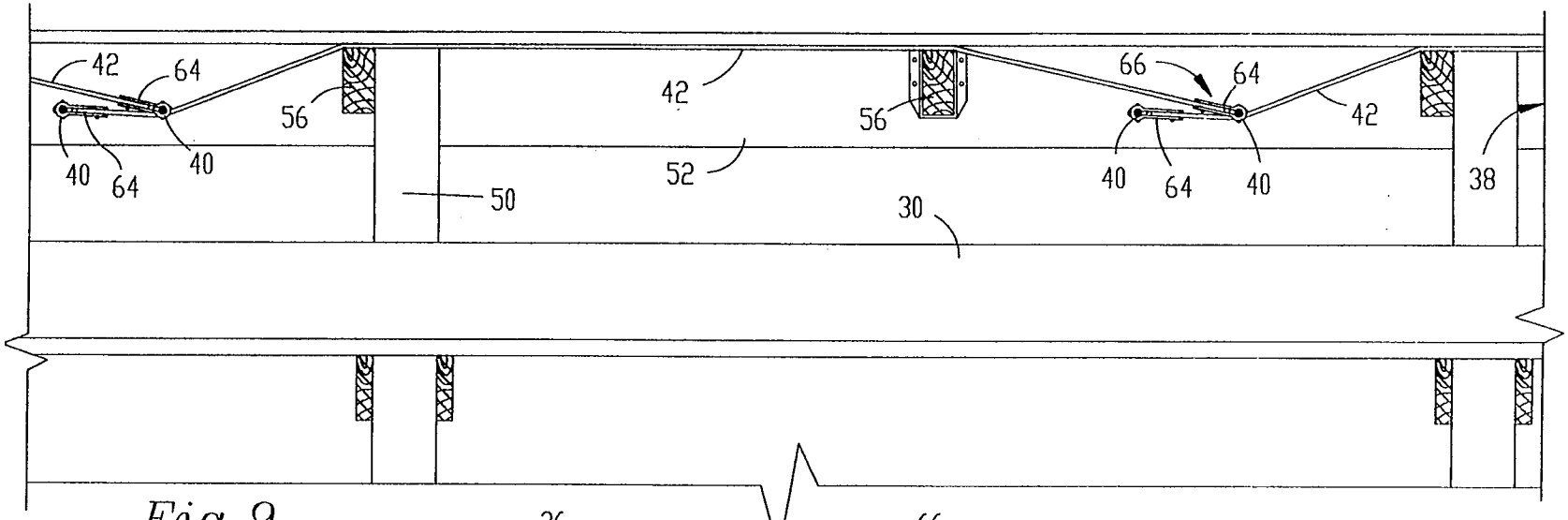
FIG. 9 is a side elevational view of the hot water distribution basin of the cooling tower, illustrating a plurality of covers on the cover unit.

Once the frame 38 is constructed, the two cables 40 associated with each cover are installed between the framing members 52, 54 as described above. As shown in FIG. 9, if desired, it is possible to position the cables so that the side edges 64 of adjacent covers overlap one another. This arrangement adds further protection against airborne debris entering the basin. However, it is preferred that each cable 40 be oriented parallel to and adjacent the closest cable of an adjacent cable pair such that a gap is defined between the covers sufficient to prevent interference when only one cover is retracted.

The end edges 60, 62 of any one of the covers may be modified as is necessary to accommodate one of the flow control units 34 or any other structure extending into the basin from above. For example, as shown in FIG. 10, the cover 42 may include a cut-out portion 88 and a plurality of grommets lining the edge of the cut-out portion so that the cover will accommodate a flow control unit. The inboard framing member also includes a cut-out portion to accommodate the flow control unit, and additional framing structure is provided for allowing the cover to be secured in place over the basin.

When it is desired to move the cover 42 in order to allow access to the basin, a maintenance person simply unties the twine 70 from the inboard framing member 52, pulls the twine from the grommet assemblies 66 on the cover 42, and pushes the cover away from the inboard framing member. Thereafter, in order to reposition the cover over the basin, it is simply pulled back toward the inboard framing member and the twine is threaded through the grommets and tied off.

Although the invention has been described with reference to the preferred embodiment illustrated in the figures, it is noted that substitutions may be made and equivalents employed herein without departing from the scope of the invention as set forth in the claims. For example although the covers in the preferred embodiment extend lengthwise between the inboard and outboard framing members, it is noted that the covers could also extend in the longitudinal direction of the basin between framing members positioned over the end walls 44 of the basin. Thus, the orientation of the covers relative to the basin is selected to provide the most easily accessible construction for a particular application.

What is claimed is:

1. A cover unit for use on a distribution basin of a water cooling tower, wherein the distribution basin includes a floor and opposed first and second side walls, the cover unit comprising:

a frame secured to the basin and including first and second framing members overlying the side walls of the basin;

a pair of connectors secured between the framing members and spaced laterally from one another;

a flaccid cover having first and second end edges and laterally spaced side edges;

a means for presenting a plurality of grommets along the lateral sides of the cover through which the connectors are threaded;

a means for attaching the end edges of the cover to the framing members for holding the cover over the basin; and a means for detaching at least one of the end edges of the cover to permit the cover to be moved along the connectors allowing access to the basin.

2. A cover unit as recited in claim 1, wherein the means for attaching the end edges of the cover to the framing members includes a securing means for securing the second edge of the cover to the second framing member, a means for presenting a plurality of grommets along the first edge of the cover, and a holding means for holding the grommets of the first edge of the cover close to the first framing member in order to retain the cover in position over the basin.

3. A cover unit as recited in claim 2, wherein the means for detaching at least one of the end edges of the cover includes means for detaching the holding means to permit the cover to be moved along the connectors away from the first framing member allowing access to the basin.

4. A cover unit as recited in claim 1, wherein the frame includes a joist mounted to the framing members above and in between the connectors, the cover being draped up over the joist so that the joist supports the cover between the connectors.

5. A cover unit as recited in claim 1, wherein the cover is formed of a material having a plurality of holes extending through the material for allowing fluid to pass through the material while a substantial percentage of sunlight striking the cover is prevented from passing through the cover into the basin.

6. A cover unit as recited in claim 1, wherein the cover is formed of woven, vinyl-impregnated polyester yarn and includes a porosity which blocks most of the sunlight striking the cover from reaching the basin.

7. A cover unit as recited in claim 1, wherein the means for presenting a plurality of grommets along the lateral sides of the cover includes a plurality of grommets attached to the cover and presenting eyelets having an inner diameter sized to slidingly receive the connectors.

8. A cover unit as recited in claim 1, wherein the connectors are cables coated with a material which decreases friction between the cables and the grommets and which inhibits rusting of the cables.

9. A cover unit as recited in claim 1, further comprising at least one additional pair of connectors secured between the framing members and spaced laterally from one another, and a flaccid cover associated with each pair of connectors, wherein each cover includes a means for presenting a plurality of grommets along the lateral sides of the cover through which the associated pair of connectors are threaded.

10. A cover unit for use on a distribution basin of a water cooling tower, wherein the distribution basin includes a floor and opposed inboard and outboard side walls, the cover unit comprising:

a frame secured to the basin and including inboard and outboard framing members overlying the inboard and outboard side walls of the basin, and a joist mounted to the inboard and outboard framing members;

a pair of connectors secured between the inboard and outboard framing members and spaced laterally from one another, the connectors being mounted beneath and to either side of the joist;

a flaccid, fluid permeable cover having inboard and outboard end edges, and laterally spaced side edges, the cover being draped up over the joist so that the joist supports the cover between the connectors;

a means for presenting a plurality of grommets along the lateral sides of the cover through which the connectors are threaded;

a means for attaching the end edges of the cover to the inboard and outboard framing members for holding the cover over the basin; and a means for detaching at least one of the end edges of the cover to permit the cover to be moved along the connectors allowing access to the basin.

* * * * *